United States Patent [19]

Niwa et al.

[11] Patent Number: 4,705,654

[45] Date of Patent: Nov. 10, 1987

[54] METHOD OF HUMIDIFYING A GAS

[75] Inventors: Kensuke Niwa; Hisayoshi Fujita, both of Tokyo; Yoshihiko Saito, Niigata; Hiroshi Makihara, Hiroshima; Ritsuo Hashimoto, Hiroshima; Younosuke Hoshi, Hiroshima; Katsutoshi Murayama, Niigata, all of Japan

[73] Assignees: Mitsubishi Jukogyo Kabushiki Kaisha; Mitsubishi Gas Chem. Company, Inc., both of Tokyo, Japan

[21] Appl. No.: 863,519

[22] Filed: May 15, 1986

Related U.S. Application Data

[63] Continuation of Ser. No. 670,610, Nov. 13, 1984, abandoned.

[30] Foreign Application Priority Data

Nov. 14, 1983 [JP] Japan ..... 58-212512
Nov. 14, 1983 [JP] Japan ..... 58-212513

[51] Int. Cl.[4] ..... B01F 3/04

[52] U.S. Cl. ..... 261/128; 165/60; 165/159; 261/97; 261/151; 261/153

[58] Field of Search ..... 261/153, 94, 112, 95, 261/110, 97, 98, 96, 128, 151, 36.1; 165/60, 159

[56] References Cited

U.S. PATENT DOCUMENTS

| | | | |
|---|---|---|---|
| 1,910,199 | 5/1933 | Brady | 261/153 |
| 2,002,019 | 5/1935 | Marzolf | 261/153 |
| 2,189,173 | 2/1940 | Hebbard et al. | 261/153 X |
| 2,545,028 | 3/1951 | Haldeman | 261/153 |
| 2,825,210 | 3/1958 | Carr | 261/153 X |
| 3,230,055 | 1/1966 | Wolfrom | 261/153 X |
| 3,271,969 | 9/1966 | Lorentzen | 261/153 X |
| 3,274,752 | 9/1966 | Huyghe et al. | 261/153 X |
| 3,292,998 | 12/1966 | James | 261/153 X |
| 3,499,734 | 3/1970 | Newman et al. | 261/153 X |
| 3,833,205 | 9/1974 | McAnespie | 261/153 X |
| 4,023,949 | 5/1977 | Schlom et al. | 261/153 X |
| 4,435,339 | 3/1984 | Kragh | 261/153 |

FOREIGN PATENT DOCUMENTS

| | | | |
|---|---|---|---|
| 95586 | 1/1960 | Norway | 261/153 |

*Primary Examiner*—Richard L. Chiesa
*Attorney, Agent, or Firm*—Holman & Stern

[57] ABSTRACT

A wetted wall type method of humidifying gas with a liquid which is composed, or mainly composed, of water wherein the liquid flows down a heated vertical wall to form a wetted wall and gas flows along the wetted wall in contact with the liquid on the wetted wall to increase the humidity contained in the gas, comprises supplying a greater amount of liquid than the amount of liquid used or evaporated for increasing the humidity, and recirculating the liquid which is not evaporated from an outlet of the wetted wall to a liquid supply portion, the amount of the flowing liquid being adapted to satisfy the following equation:

$$q < 5.99 \times 10^5 \Gamma^{2.12} \quad (1)$$

wherein q is the heat flux in $W/m^2K$ where W = watts, K = temperature in degrees Kelvin, and Γ is the amount of flowing water with regard to the mass of water per unit wet width in kg/ms.

6 Claims, 7 Drawing Figures

METHOD OF HUMIDIFYING A GAS

This is a continuation of application Ser. No. 670,610 filed Nov. 13, 1984, now abandoned.

BACKGROUND OF THE INVENTION

1. Field of the Invention

The present invention relates to humidification of a gas, and more particularly to an improved method of humidifying a gas wherein gas and liquid are directly brought into contact with each other and the liquid is indirectly brought into contact with a third fluid so that heat contained in the third fluid is used to evaporate the liquid and increase the humidity contained in the gas.

2. Description of the Prior Art

Generally, a humidifier has been used for mixing steam into hydrocarbon gas in a process in which hydrocarbon gas and steam are mixed in a predetermined ratio and heated together with a catalyzer to be reformed in a steam reforming method to produce gas as a raw material for synthesizing ammonia or methanol.

As an example of a humidifier which has been used heretofore, there is a wetted wall type humidifier in which gas and water are directly brought into contact with each other by using a wetted wall to increase the humidity in the gas. FIG. 1 schematically shows the wetted wall type humidifier.

In FIG. 1, water 102 is supplied from a spray 105 and flows down over the upper portion of a heat conductive pipe 104 to form a liquid film on its inner surface. When the water flows down the inner portion of the pipe 104, the water is heated by heat supplied by a heating medium 103 through a wall of the pipe and evaporated.

Gas 101 is supplied through a channel inlet 106. The gas is heated and the humidity contained in the gas is increased in the pipe 104 and is then collected from a channel outlet 107.

The heating medium 103 is supplied through a side fluid inlet 108 and flows through the space surrounding the pipe to heat the fluid flowing in the pipe, and is thereby cooled. The heating medium 103 is then withdrawn from the humidifier through a side fluid outlet 109. Reference numeral 110 denotes a baffle plate, and reference numeral 111 denotes a pipe plate. While only the single pipe 104 is illustrated in FIG. 1, it is needless to say that a plurality of pipes is required to obtain sufficient effect upon implementation of the process.

FIG. 2 shows an enlarged longitudinal cross sectional view of a portion of the heat transfer pipe 104 shown in FIG. 1. Reference numerals 101–104 designate the same elements as those in FIG. 1. Reference numeral 202 denotes water film.

The conventional method and apparatus shown in FIG. 1 is disadvantageous in that the water film 202 is broken and the wall surface is dried when the amount of water is reduced too much. This phenomenon is hereinafter referred to as "the occurrence of dry patches". The occurrence of dry patches is due to the local surface tension distribution of the liquid film or the production of air bubbles by the film boiling when of being heated, and tends to be generated in the area in which the amount of water is less owing to evaporation. The occurrence of dry patches produces the following disadvantages.

(1) Concentration of the $Cl^-$ ions in water is effected upon the occurrence of dry patches and stress-corrosion cracking (SCC) may occur in the heat conductive pipe if pipe formed of austenitic stainless steel is used. (Since general carbon steel produces corrosion due to carbonic acid, stainless steel is often used.)

(2) Local thermal stress repeatedly occurs due to temperature variation by the phenomenon that the wall surface is irregularly dried and wetted, and thermal fatigue may occur in the heat conductive pipe.

BRIEF SUMMARY OF THE INVENTION

It is an object of the present invention to remove the drawbacks in the prior art and provide an improved method which prevents a heat conductive pipe from being broken by the occurrence of dry patches.

The inventors have found as a result of extensive research and development for achieving the above objective that the drawbacks in the prior art can be overcome by recirculating water to the extent that dry patches are not produced and by increasing the amount of water on the inner surface of the pipe per unit width.

It is a further object of the present invention to overcome the above drawbacks in the prior art and to provide a with higher efficiency for increasing the humidity. As a result of research and development, the inventors have produced a humidifying method of the present invention in which a pipe filled with filling members is used in lieu of the prior art pipe forming the wetted wall, and gas and liquid flow in the pipe filled with the filling members at the same time so that a thin liquid film in contact with the pipe wall is formed and the direct contact area between the gas and the liquid is enlarged to increase the humidity contained in the gas.

The method of the present invention can form the wetted wall under the condition of a wider range than in the prior art methods and apparatus and can increase the effective interface area between the gas and the liquid to facilitate the evaporation of the liquid. The present invention can be widely utilized as a method of humidifying or saturating natural gas in a methanol plant reforming system or another common humidifier.

The gist of the present invention resides in a method of humidifying a gas, such as, e.g. in a wetted wall type humidifier in which liquid composed of, or mainly composed of, water flows down a vertical wall of a pipe of a vertical shell-and-tube type heat exchanger to form a wetted wall, gas flows in the pipe, and heating medium flows in the shell side to increase the humidity contained in the gas which is in contact with the wetted wall, characterized by supplying a greater amount of liquid composed of, or mainly composed of, water than the amount of liquid evaporated in the pipe and recirculating liquid which is not evaporated from an outlet of the wetted wall to a liquid supply portion.

Further, the gist of the present invention resides in the above method characterized in that the amount of the flowing liquid supplied in the pipe is adapted to satisfy the following equation:

$$q < 5.99 \times 10^5 \Gamma^{2.12} \quad (1)$$

where q is heat flux in $W/m^2K$. where W = watt, and K. = temperature in degrees kelvin, and $\Gamma$ is the amount of flowing water with regard to the mass of water per unit wet width in kg/ms.

In addition, the gist of the present invention resides in the above method characterized in that the pipe is filled with filling members.

BRIEF DESCRIPTION OF THE DRAWINGS

The present invention will now be described in detail with reference to the accompanying drawings, wherein.

DETAILED DESCRIPTION

Figure 1:
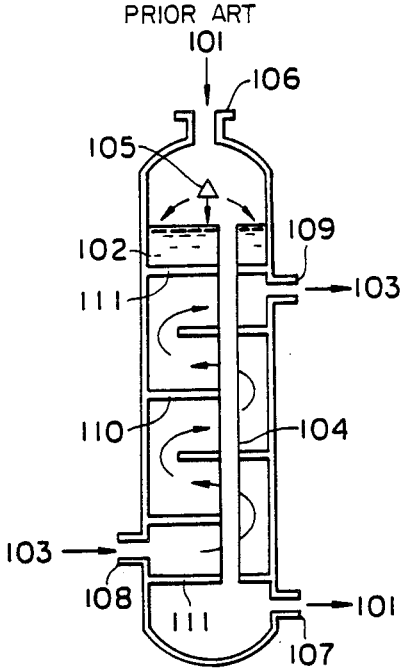
FIG. 1 PRIOR ART
FIG. 1 is a schematic cross-sectional view of a prior art wetted wall type humidifier.
Figure 2:
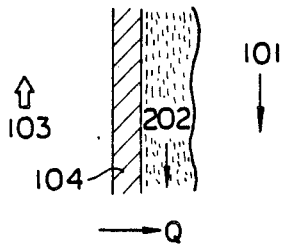
FIG. 2 PRIOR ART
FIG. 2 is an enlarged partial longitudinal cross sectional view of a pipe in the prior art humidifier in FIG. 1.
Figure 3:
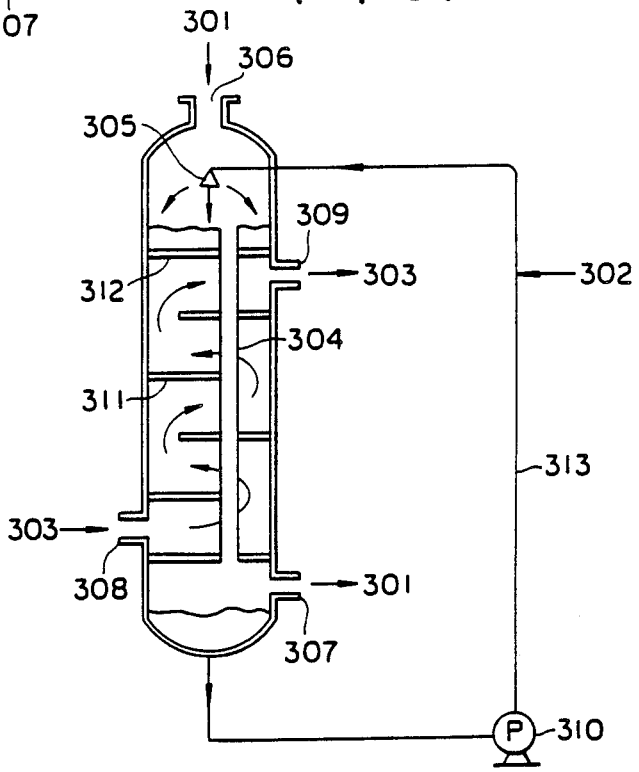
FIG. 3 is a schematic cross-sectional view of one embodiment of a humidifier utilizing the method of the present invention.

Referring to FIG. 3, there is shown one embodiment of a method as used in a humidifier according to the present invention. In FIG. 3, reference numeral 301 denotes gas, 302 supply water, 303 heating medium, 304 a heat conductive pipe, 305 a spray, 306 a channel inlet, 307 a channel outlet, 308 fluid inlet in shell side, 309 fluid outlet in a shell side, and 310 a circulating pump.

In FIG. 3, while only the single pipe 304 is shown for the convenience of explanation, it is needless to say that a plurality of pipes are required to obtain sufficient humidifying effect upon implementation of the invention.

The heating medium 303 is supplied from the inlet 308 and flows along the external surface of the pipe 304 to heat the fluid in the pipe. The medium is cooled and withdrawn from the outlet 309.

The gas 301 is supplied through the channel inlet 306 and is heated in the pipe 304 to increase the humidity. The humidified gas is collected from the channel outlet 307. The respective flows of the heating medium 303 and the gas 301 are determined on the basis of the process condition.

The water 302 is supplied from the spray 305 and flows down the internal surface of the pipe 304 to form a liquid film while being evaporated. The water which has not evaporated is recirculated through a line 313 to the upper spray 305 by means of the pump 310. The supply water 302 is supplied by the amount of water which has not evaporated from the spray 305.

The amount of recirculating water is determined by the condition in which the dry patches do not occur. In other words, the liquid film is required to be stably formed under the adiabatic condition, the heating condition (in the non-boiling area) and the film boiling condition. For example, it is desired that the following respective conditions are satisfied.

(1) The adiabatic condition: The Reynolds number of the liquid film $Re_L > Re_{min}$ is required to be satisfied.

$$Re_L = 4GL/N\pi d\mu_L \ (-)$$

where $G_L$: Total amount of circulating water with regard to mass (kg/s)

N: Number of pipes 304 (−)

d: Inner diameter of the pipe 304 (m)

$\mu_L$: Coefficient of viscosity of circulating water (Pas)

$6_L$: Surface tension of circulating water (N/m)

$\rho_L$: Density of circulating water (kg/m$^3$)

g: Acceleration of gravity (m/s$^2$)

For example, Re min is expressed by:

$$Re_{min} = 3.4\left(\frac{6_L{}^2\rho_L}{\mu_L{}^4 g}\right)^{1/5} (-)$$

(2) The heating condition (in the non-boiling area): It is required to satisfy the heat flux q≦q min, which is given by:

In the case of $Re_L \leqq 2000$ $$q_{min} = 5.6 \times 10^{-4} K_L \rho_L g \left(\frac{\mu_L{}^2}{\rho_L{}^2 g}\right)^{1/3} \left(-\frac{2\sigma}{2T}\right)^{-1} Re_L^{4/2}$$

In the case of $Re_L > 2000$ $$q_{min} = 5.7 \times 10^{-7} K_L \rho_L g \left(\frac{\mu_L{}^2}{\rho_L{}^2 g}\right)^{\frac{1}{3}} Pr^{0.344} \left(-\frac{2\sigma}{2T}\right)^{-1} Re_L^{2.12}$$

where $K_L$: heat conductivity of circulating water in W/mk (W: watt, K.: kelvin)

Pr: Prandtl number of circulating water (−)

T: temperature (°C.)

Figure 4:
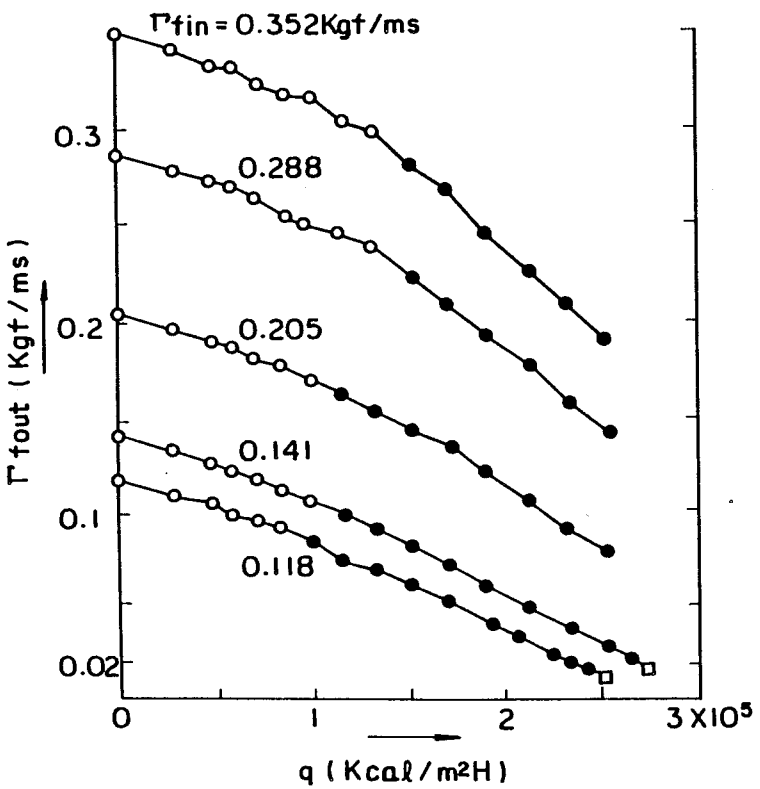
FIG. 4 is graph showing the general relation between the heat flux q and the amount of flowing water with regard to the mass of water per unit wet width.

(3) The film boiling condition: For example, the condition where the dry patches do not occur is obtained by using FIG. 4, which is described in Collected Papers of Japanese Mechanical Institution, Vol. 43, No. 373 (September 1977), page 3389–3398, by Fujita and Ueda. FIG. 4 shows graphs in downward stream of vapor having a length of 600 mm, a diameter of 25 m and $\Gamma_{fin}$ of 95.5° C. In FIG. 4, "●" indicates the occurrence of dry patches which disappear, and "□" indicates the occurrence of dry patches which do not disappear. In FIG. 4, $\Gamma_f$ means $\Gamma_f = G_L/N \times d$ and a suffix "in" represents inlet with a suffix "out" representing outlet. Accordingly, the dry patches due to the film boiling do not occur if $\Gamma_{fout} \geqq 0.02$ (kgf/ins) when the heat flux is equal to or less than $2 \times 10^5$ (kcal/m$^2$h), for example.

In the actual operation condition, since temperature of liquid film is 230° C. and $Re_L > 2000$, the most important equation is the following equation described in item (2):

$$q_m = 5.7 \times 10^{-7} K_L \rho_L g \left(\frac{\mu_L{}^2}{\rho_L{}^2 g}\right)^{\frac{1}{3}} P_r^{0.344} \left(-\frac{2\sigma}{2T}\right)^{-1} Re_L^{2.12}$$

When the physical property values of the liquid film at 230° C. (coefficient of viscosity $\mu_L$, density $\rho_L$, Prandtl number Pr, surface tension $\sigma$, heat conductivity $K_L$, etc.) are substituted, the following equation is obtained:

$$q < 5.99 \times 10\Gamma^{2.12} \quad (1)$$

Figure 5:
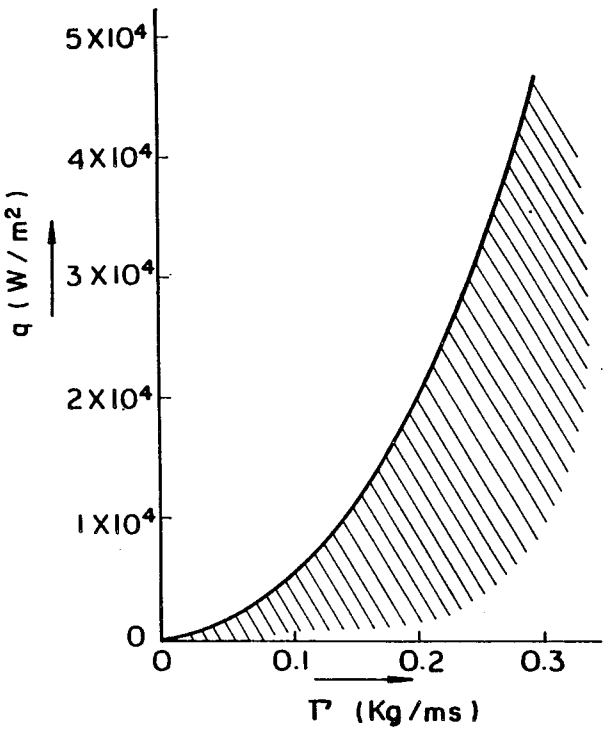
FIG. 5 is a graph showing the operational condition of the present invention.

FIG. 5 shows a graph derived from the above equation (1). Operation in the hatched area of FIG. 5 can achieve the objective of the present invention.

In accordance with the humidifying method of the present invention above described in detail, since dry patches do not occur, the chlorine ion $Cl^-$ does not concentrate on the wall of the pipe and there is no possibility of stress-corrosion cracking, thereby resulting in the heat conductive pipe being capable of being formed of stainless steel. Further, since alternate drying and wetting of the wall of the pipe is prevented, the pipe is prevented from being broken due to thermal fatigue. In order to prevent the occurrence of dry patches, it is necessary that the amount of water supplied to the inner surface of the pipe is equal to or more than the amount of water which is evaporated. For this purpose, water which is not evaporated is recirculated and the amount of heat received by the circulating water can be effectively used.

The present invention can be used for example as a natural gas humidifying or saturating method in a methanol plant reforming system, or other general humidifiers.

Figure 6:
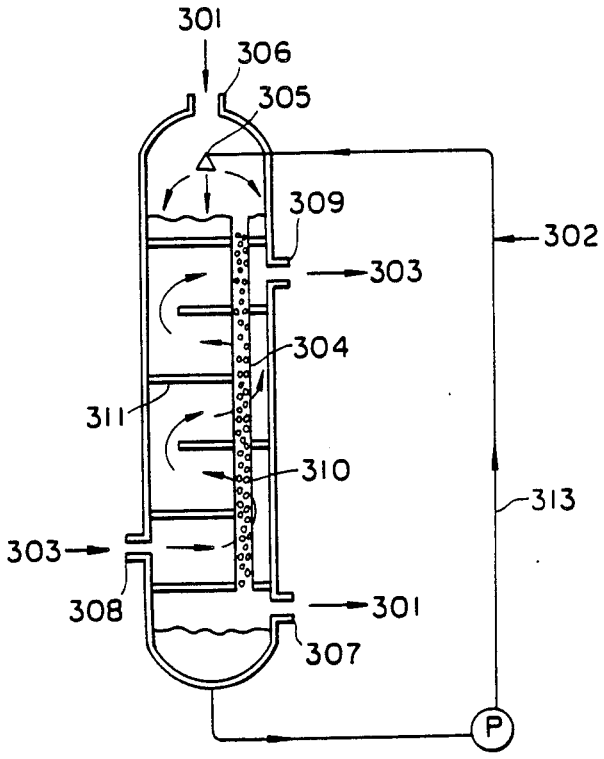
FIG. 6 is a schematic cross-sectional view of another embodiment of a humidifier utilizing the method of the present invention.

Referring now to FIG. 6, there is shown another embodiment of the invention used in a humidifier. In the drawing, reference numerals 301–313 designate the same elements as in the apparatus of FIG. 3.

In FIG. 6, while only a single pipe 304 for forming the liquid film is shown for the convenience of explanation, it is needless to say that pipe groups composed of a multiplicity of pipes are used in an actual apparatus in the implementation of the present invention.

Figure 7:
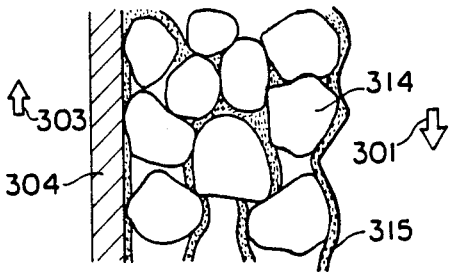
FIG. 7 is an enlarged partial longitudinal cross-sectional view of a pipe filled with filling members used in the humidifier of FIG. 6.

FIG. 7 shows an enlarged partial longitudinal cross-section of the pipe 304. The pipe 304 is filled with filling members 314, and thus liquid film 315 is formed on the inner surface of the pipe 304 and the surfaces of the filling members 314. Accordingly, the direct contact area between the liquid film 315 and the gas 301 is increased substantially by the liquid film 315 formed on the surfaces of the filling members 314 as compared with the prior art wetted wall type humidifier.

Additionally, since the liquid flowing down along the filling members 314 branches off and joins repeatedly, it is not necessary to provide a wetted wall forming mechanism on the upper end of the pipe and a strict verticality as required in the prior art.

Further, the liquid is heated when flowing down the pipe while being in contact with the wall of the pipe, and the liquid is evaporated when in contact with the gas flowing down along the surfaces of the filling members. The filling members increase the flowing velocity of the gas 301, and the reduction of the representative length of the Nusselt number and the Sherwood number increases the heat conductivity and the mass conductivity between the gas 301 and the liquid.

The increase of the interface area between the gas and the liquid and the increase of the movement coefficient with regard to the heat movement and the mass movement as well as the increase of the propellant force of the movement by continuously renewed heating surface and evaporation surface act in multiplication, and therefore the method of the present invention can enhance the humidity increasing efficiency as compared with the prior art wetted wall type humidifier.

The filling members filled in the pipe of the apparatus utilizing the present invention can be generally usable filling members such as ball type, Raschig rings, pall rings or the like. The effect of the present invention will now be demonstrated concretely in accordance with the embodiment which will now be described.

The method of the present invention (as used in a humidifier using many pipes in the apparatus of FIG. 6) is used to increase the humidity in natural gas. An embodiment is shown in Table 1. Water is used as the liquid for evaporation, and steam-reformed natural gas which is subject to the primary heat withdrawal is used as the heating medium. The water and the natural gas flow in the same direction in contact with each other.

TABLE 1

| | | |
|---|---|---|
| (Condition of pipe) | Inner diameter | 21 · 4 mmϕ |
| | Outer diameter | 25 · 4 mmϕ |
| | Pitch | 32 · 0 mm |
| | Total number | 315 pipes |
| | Material | SUS 304 (heat conductivity 17.8 W/m · °K.) |
| | Coefficient of conductive heat dirt | |
| | inner 0.000172 $(W/m^2 \cdot °K.)^{-1}$ | |
| | outer 0.000172 $(W/m^2 \cdot °K.)^{-1}$ | |
| (Filling members) | Porcelain Rasching ring | 5 mmϕ × 5 mmH |
| (Heating condition) | Heating medium | Steam-reformed natural gas |
| | Temperature at inlet | 323° C. |
| | Temperature at outlet | 190° C. |
| | Film coefficient of heat transfer of heating medium | 1300 $W/mm^2 \cdot K$ |
| (Liquid for evaporation) | Amount of flowing water | 11.2 kg/sec |
| | Temperature at inlet | 138° C. |
| | Temperature at outlet | 191° C. |
| (Natural gas) | Amount of flowing | 3.9 kg/sec |
| | Temperature at inlet | 138° C. |
| | Temperature at outlet | 172° C. |
| | Humidity at inlet | 0 wt % $H_2O$ vapor |
| | Humidity at outlet | 49 wt % $H_2O$ vapor |

What is claimed is:

1. A method of humidifying a gas comprising:

flowing a liquid composed mainly of water over one surface of a heat conducting wall to form a wetted wall;

flowing a gas to be humidified over said one surface in contact with said wetted wall;

flowing a heating medium over the other surface of said wall for heating the wall to evaporate said liquid and humidify said gas; and recirculating said liquid which is not evaporated to said liquid flowing over said one surface for providing a greater amount of said liquid flowing over said one surface than the amount of liquid evaporated so that the amount of liquid supplied for flowing over said one surface prevents dry patches from forming on said one surface and satisfies the following equation:

$$q < 5.99 \times 10^5 \Gamma^{2.12} \quad (1)$$

where;

q is the heat flux in $W/m^2K$.

where,

W = watts

K. = temperature in degrees Kelvin and

Γ = amount of flowing liquid with regard to the mass of liquid per unit wet width in kg/ms.

2. The method as claimed in claim 1 wherein: said gas flow is in the same direction of flow as said liquid.

3. The method as claimed in claim 2 wherein: said wall is vertical and said liquid flows downwardly.

4. The method as claimed in claim 1 wherein: said wall is vertical and said liquid flows downwardly.

5. In a wetted wall type method of humidifying a gas wherein liquid composed mainly of water from an inlet therefor in the shell of a vertical shell-and-tube type heat exchanger flows down a vertical wall of each tube having an inlet and an outlet to form a wetted wall in each tube, and gas flows from an inlet therefor through each tube, and heating medium flows from an inlet therefor through the shell in contact with the outer side of each tube to heat the tube and evaporate the liquid to increase the humidity of the gas which is in contact with the wetted wall, the improvement comprising:

recirculating said liquid which is not evaporated from the outlet of the wetted wall tubes to the liquid inlet for supplying a greater amount of liquid composed mainly of water than the amount of liquid evaporated in each tube;

so that the amount of the flowing fluid supplied in each tube prevents dry patches from forming on said wetted wall of said each tube and satisfies the following equation:

$$q < 5.99 \times 10^5 \Gamma^{2.12} \quad (1)$$

where;

q is the heat flux in $W/m^2K.$;

where,

W = watts;

K. = temperature in degrees Kelvin; and $\Gamma$ = amount of flowing water with regard to the mass of water per unit wet width in kg/ms.

6. The method as claimed in claim 5, and further comprising: increasing the area of the gas-liquid interface by providing discrete filling members in each tube having a shape to provide spaces for the flow of liquid between said filling members and between said filling members and the wetted wall in each tube.

* * * * *